US010655944B1

(12) United States Patent
Gent

(10) Patent No.: US 10,655,944 B1
(45) Date of Patent: May 19, 2020

(54) BULLET SEATING DIE FOR SHOULDER BREECHING RIFLE CARTRIDGES

(71) Applicant: Jeffrey Howard Gent, Brownsville, OR (US)

(72) Inventor: Jeffrey Howard Gent, Brownsville, OR (US)

( * ) Notice: Subject to any disclaimer, the term of this patent is extended or adjusted under 35 U.S.C. 154(b) by 0 days.

(21) Appl. No.: 16/371,034

(22) Filed: Mar. 31, 2019

(51) Int. Cl.
*F42B 33/02* (2006.01)
*F42B 33/00* (2006.01)

(52) U.S. Cl.
CPC ..... *F42B 33/005* (2013.01); *F42B 33/002* (2013.01)

(58) Field of Classification Search
CPC ..... F42B 33/02; F42B 33/001
See application file for complete search history.

(56) References Cited

U.S. PATENT DOCUMENTS 4,869,148 A * 9/1989 Tucker ..... F42B 33/001 86/43

* cited by examiner

*Primary Examiner* — J. Woodrow Eldred

(57) ABSTRACT

A bullet seating die for assembling shoulder breeching rifle cartridges that aligns the bullet co-axial with the case shoulder. Bullet seating depth is set relative to the datum line of the case shoulder and is adjustable. Shoulder breeching rifle cartridges use the shoulder, exclusively, to position the cartridge in the chamber. Therefore, cartridges assembled with this die will position the bullet concentric with the bore of the barrel and at a set distance from the bore with greater precision and consistency than cartridges produced by die of previous designs.

3 Claims, 2 Drawing Sheets

BULLET SEATING DIE FOR SHOULDER BREECHING RIFLE CARTRIDGES

CROSS-REFERENCE TO RELATED APPLICATIONS

Not Applicable

BACKGROUND OF THE INVENTION

This invention pertains to the making of ammunition cartridges for rifles such as those used by hunters, military, and competitive shooters.

Rifle chamber and ammunition cartridge designations are standardized by the Sporting Arms and Ammunition Manufacturer's Institute (SAAMI). ANSI maintains a corresponding standard Z299.4. These standards define, among other things, the physical dimensions of the cartridge and chamber for each cartridge designation by way of a mechanical drawing specifying the dimensions and tolerances for each feature. These dimensions and tolerances dictate how the cartridge will fit into the chamber, take into account changes in the cartridge dimensions during firing, and also account for normal manufacturing variation to ensure that all commercial ammunition will function in all commercial rifles. Allowable variations are small but they can have a significant effect on accuracy because they may alter the way a bullet enters the barrel which affects how it leaves the barrel which affects downrange accuracy. One of the motivations for hand loading ammunition is to take advantage of the ability to adjust the final dimensions of the cartridge to closely match the chamber of a particular rifle and to also decrease the variation from cartridge to cartridge thereby increasing accuracy and consistency.

Ammunition cartridges are assembled from a case, a primer, powder, and a bullet and are put into several broad classes based on the type of case that is used: rimmed, rimless, and belted being the most common types. Each of these three types of cases use a different physical feature on the case to locate the case inside the chamber, which is commonly called 'headspacing' but within the SAAMI specification this is called 'breeching'. Rimmed and belted cases are breeched by ("headspace off of" is the common terminology) the rim or belt, both features being located at the head of the case (end opposite the bullet). Rimless cases are breeched by ("headspace off of") the shoulder, the conical transition between the larger cylindrical body of the case, which holds the powder, and the smaller cylindrical neck, which holds the bullet. This is a difference that the prior art has not addressed. All of the different reloading dies, overall-length-gauges, bullet comparators, other tools, and the techniques for using them that are contained in the prior art and commercially available make no differentiation between these different case types, essentially treating all of them as if they were of the rimmed type where all critical dimensions are referenced from the head of the case and alignment is controlled by adjustments to the body and neck of the case. For shoulder breeching cartridges critical dimensions are properly referenced to the case shoulder and it is the case shoulder that should be used to align the bullet.

Among other things, careful hand loaders are concerned with the distance that the bullet moves before it engages the rifling of the barrel (called 'bullet jump') and the concentricity of the bullet with the bore of the barrel. Several problems arise when loading shoulder breeching cartridges with existing die designs. One is that variations in the length of the case body between the head and the shoulder are translated into variations in bullet jump. This does not occur with rimmed or belted cases because the rifle chamber and the loading press/die are using the same control point, the rim or belt. Existing die and presses are designed to control the Cartridge Overall Length (C.O.L.), the length from the head of the case to the tip of the bullet. This is the sum of two values: the length of the case body from the head of the case to the shoulder and the length from the shoulder to the bullet tip. With existing die designs, a reduction in the length of the case body will result in an increase in the distance from the shoulder to the bullet tip but the C.O.L will remain unchanged. For rimmed and belted cases it is changes in C.O.L. that cause changes in bullet jump so these case designs are not affected by changes in body length. But in a shoulder breeching case, it's changes in the distance from the shoulder to the bullet that cause changes in bullet jump. Therefore, with present die designs any change in the case body length will cause a change in the final shoulder to bullet length, which will cause a change in bullet jump. Because variation in body length from case to case naturally exists, uncontrolled variation in bullet jump must be the result with existing designs.

Another problem that arises from using existing die designs with shoulder breeching cartridges is that changes in bullet shape also affect bullet jump. Even within a box of the same bullets from a reputable maker significant amounts of variation are expected, so many loaders weigh each bullet to create batches that all have the same weight. Any change in weight necessarily translates into changes in length at or near the tip, so even when using the same bullets from the same box there is variation in length that will cause changes in bullet jump. Additionally, hand loaders use a variety of bullets in the same case that have significant differences in the shape of the tip. A longer bullet will cause the bullet to be pushed farther into the case, which increases bullet jump. Therefore, a hand loader wishing to control bullet jump needs to carefully adjust existing seating die designs every time they use a different bullet type.

Existing seating die designs also handle concentricity incorrectly for shoulder breeching cases. A bullet is deformed by the rifling grooves as it is forced into and down the barrel and those grooves force the bullet to spin about the central axis of the barrel (not the central axis of the bullet). If the central axis of the bullet is not perfectly concentric to the axis of the barrel then the bullet will be asymmetrically deformed and the center of mass will be forced to rotate about the axis of rotation. The result is a bullet which wobbles in flight. This has an unpredictable, and therefore deleterious, effect on downrange accuracy.

The problem with the existing tools and techniques appears to arise from a lack of appreciation of what the shoulder is doing in a shoulder breeching cartridge case. For rimmed and belted cartridge cases the shoulder is just a transition between the enlarged body and the neck and it does not contact the shoulder of the chamber. Rimmed and belted cases rely on the interface of the rim and belt with the face of the rifle chamber to control the depth of the bullet and on the fitment of the body with the walls of the chamber to control concentricity. Therefore, in rimmed and belted cases the shoulder doesn't contribute to accuracy and can be ignored. Careful hand loaders, particularly competitive shooters using what is commonly called 'bench rest' loading techniques and tools (which do not take into account what the shoulder is doing) therefore spend a great deal of time worrying about aligning the exterior of the neck (which positions the bullet) to the body in an effort to control concentricity of the bullet and the bore of the barrel.

However, in a shoulder breeching cartridge the shoulder of the case is pushed against the shoulder of the chamber and is the only point of contact between the case and chamber. This forced contact between case and chamber at the shoulder is what aligns the case and controls bullet depth. The body does not contact the chamber walls so it is the body that should be ignored, not the shoulder.

This is a critical distinction that is being ignored by the existing technology so I have designed a set of tools for loading cartridges that are similar to existing tools but are designed specifically for shoulder breeching rifle cartridges. These include tools for measuring the chamber and ammunition properly, a case hone, a neck sizing die, and a bullet seating die, each of which is the subject of a separate invention disclosure. This disclosure is for the bullet seating die.

I will be using the term 'datum line' in the description of the invention. This is a term I have found used in some of the relevant literature and it appears to have been in use and well accepted for a long time and thus reasonable to adopt. However, the only official documentation is the SAAMI specification, which does not use this term, so it needs to be defined. The 'datum line' is not a visible feature on the cartridge but is the median diameter of the conical shoulder. In the SAAMI Cartridge and Chamber Drawings for shoulder breeching cartridges the datum line is the line drawn through the center of the shoulder, denoted with a "B" for being a 'basic dimension,' and also denoted with an 'x' inside an 'o' on the chamber drawing for being the 'headspace dimension'. This is also the only place in the drawings where the dimension for the cartridge and the matching dimension for the chamber are the same value. This means that the shoulder is the only place where the cartridge is expected to make contact with the chamber. For an example, see the drawings for the 30-06 Springfield and find the line through the shoulder with a diameter of 0.375 inches.

I need to create a new term: 'bullet datum', which I define as the place where the cross sectional diameter of the bullet is the same as the bore diameter specified in the SAMMI Cartridge and Chamber Drawing. For the 30-06 Springfield this value is 0.300 inches. This is similar to the 'ogive', which refers to the forward most part of the bullet having the base diameter; this is 0.309 inches for the 30-06 Springfield. The bullet datum will always be slightly forward of the ogive. Both are near the middle of the bullet and neither are visible features. No one else uses this part of the bullet as a reference point so this is a unique concept. I use it because the exact position of the ogive is difficult to locate, so an alternative is needed. Almost half of a typical bullet has the ogive diameter so it's hard to know exactly where on the bullet a measurement taken from the ogive diameter is being taken from. However, there is only one place on the bullet which has the bore diameter so it's very easy to precisely define and that place is fully on the taper of the bullet so it's pragmatically easier to locate precisely.

This disclosure does not discuss how to measure a chamber in order to know what the proper distance is to set up the internal assembly of this die, nor how to measure a cartridge that is produced by this die to ensure that it is properly sized. The technology for making these measurements precisely does not exists. The challenge in both situations is that the reference point is in the middle of a conical section so there isn't a physical feature to anchor one end of a measurement device on nor any visible indicator of where it is. It is still probably possible to make this die work well through trial and error but it would be better to solve the problem on how to take a precise measurement from the center of a cone. I have developed an elegant solution to the problem but because the result is a tool of general applicability and not just a tool for measuring rifle chambers and setting up this seating die it is the subject of another disclosure.

BRIEF SUMMARY OF THE INVENTION

The object of this invention is better control of bullet jump and concentricity for shoulder breeching rimless rifle cartridges than existing tools and methods provide, thereby producing an appreciable improvement in accuracy and consistency. Disclosed is the Shoulder Breeching Seating Die, a bullet seating die for use in common loading presses which does two things that are unique:

- the bullet is aligned to the axis of the shoulder using a three-stage process
- the seating depth, which is adjustable, is based on the distance between the shoulder datum and the bullet datum and is therefore unaffected by changes in bullet tip shape or case body length.

This result is accomplished by the uniquely designed internals of the Shoulder Breeching Seating Die. Inside the die, sitting at the bottom of the shell, is a removable adjustable assembly of two pieces that are joined by precision threads and a lock ring. The bottom half of the assembly has a conical mouth with a cone angle and nominal diameter that matches the shoulder of the cartridge case. The seating operation begins with the bullet entering the mouth unaligned. The bullet is partially aligned as it passes through the mouth (stage 1 of the alignment process). The top half of the assembly has a blind bore that receives the bullet; the diameter of the bore equals the bullet datum value. Turning the upper half against the lower half changes the distance from the bottom of this bore to the mouth, which adjusts the seating depth. Through very careful manufacturing the central axis of the bore and the conical mouth are co-axial to very tight tolerances. As the press ram moves upward, the tapered bullet is seated into this hole where it naturally aligns itself to the hole (stage 2 of the alignment process). As the press ram continues to rise the case and bullet lift the assembly inside the shell until it hits the probe of a force gauge on top of the shell. The bullet is then forced into the case as the ram continues to rise, with the dial gauge indicating how much force is being applied. The ram continues to rise until the shoulder of the case makes contact with the conical mouth. The cone-to-cone interface between the case shoulder and the mouth mimics the interface of the case shoulder to chamber shoulder. The cartridge case is pressed against the mouth by the ram, which aligns the central axis of the case shoulder to the axis of the mouth, which is aligned to the bore, which is aligned to the bullet, thereby bringing the central axis of the cartridge case into alignment with the central axis of the bullet (stage 3 of the alignment process). The distance from the bottom of the bore in the top half of the internal assembly to the center of the mouth dictates the resulting distance from the bullet datum to the shoulder datum, which is independent of changes in the shape of the bullet tip or changes in case body length.

To reiterate, unlike all other die designs the Shoulder Breeching Seating Die only works well with shoulder breeching rifle cartridges. Rimmed and belted cartridges could be loaded with the Shoulder Breeching Seating Die but the result would be an increase in variation not a decrease.

Figure 1:
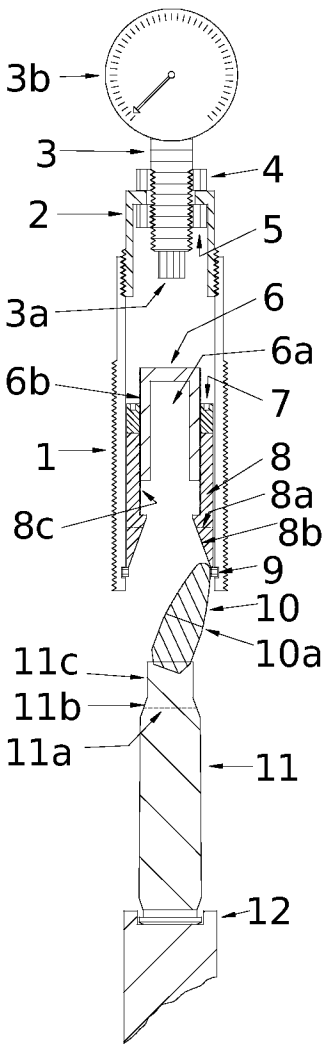
FIG. 1 illustrates, in cut-away profile view, the preferred embodiment of the Shoulder Centered Breeching Die which is used in manually operated reloading presses. Each cartridge has a unique shape as defined by SAAMI, therefore critical dimensions of the internal die components will change to match the cartridge the die is designed for. The Shoulder Breeching Seating Die is assembled from a plurality of items generally having a circular cross section.

- the shell (1), a tube with threads on the lower half of the exterior for mounting the die into a press and a smooth bore with threads at the upper end of the bore;
- the cap (2), having threads on the bottom half of the exterior for attachment to the shell (1) and a hole through the top;
- the force gauge (3), a typical mechanical force gauge having a probe (3*a*) and a dial (3*b*);
- two nuts (4) and (5) that secure the force gauge (3) to the cap (2);
- the case stop (8), which has an outer diameter with a slip fit to the inner diameter of the shell (1), a conical mouth (8*b*) at the bottom with a median diameter (8*a*) and cone angle that matches the shoulder datum diameter (11*a*) and cone angle of the case shoulder (11*b*), and a threaded bore (8*c*) in the upper half;
- the bullet stop (6), which has exterior threads (6*b*) for threading into the threaded bore (8*c*) of the case stop (8) and a blind bore (6*a*) with a diameter equal to the bullet datum diameter (10*a*), the bore (6*a*) being deep enough to accommodate the maximum expected bullet length;
- the lock ring (7), with inner threads for threading onto the threads on the exterior of the bullet stop (6*b*) and against the case stop (8), locking the two stops together;
- a c-clip (9) prevents the case stop (8) from falling out the bottom of the shell (1).

The rest of FIG. 1 includes elements necessary to support the description of how the Shoulder Breeching Seating Die (1-9) functions during operation. FIGS. 2 through 5 contain the same elements as FIG. 1, these figures are included to support the description of how the internal elements function during operation and why this is different from existing designs. These drawings present the rising ram style of loading press where the die is held stationary and the ram (12) lifts the case (11) and the bullet (10) into the die, for clarity the rest of the press is not illustrated.

FIG. 1 presents the start-of-operation condition where the bullet (10) sits atop the case neck (11*c*) severely misaligned. Several items are not visible physical features but are datum lines; which indicate where on the object the cross sectional diameter is a particular value; which will also be referred to as the median diameter; these are:

- the case shoulder datum (11*a*), having a diameter defined by the SAMMI specification;
- the bullet datum (10*a*), having a diameter equal to the bore diameter defined by the SAMMI specification;
- and the case stop mouth datum (8*a*), where the median diameter of the mouth (8*b*) equals the diameter of the case shoulder datum (11*a*).

Figure 2:
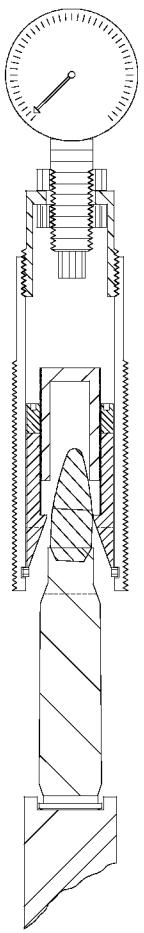

FIG. 2 illustrates when the ram (12) has raised to the point where the bullet (10) has passed through the mouth of the case stop (8*b*) and thereby has become partially aligned.

Figure 3:
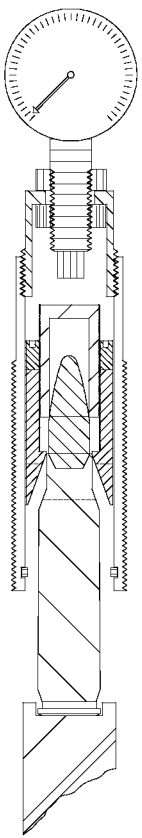

FIG. 3 illustrates when the ram (12) has raised to the point where the bullet (10) has contacted the bullet stop (6) and thereby has lifted the case stop (8) off of the c-clip (9). The bullet datum (10*a*) is level with the bottom edge of the bore in the bullet stop (6*a*).

Figure 4:
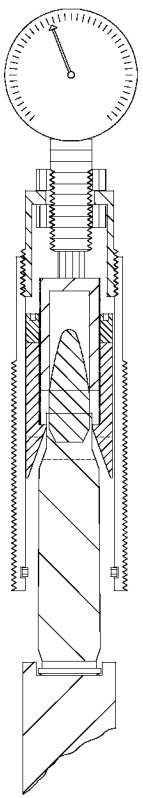

FIG. 4 illustrates when the ram (12) has raised to the point where the bullet stop (6) has contacted the probe of the force gauge (3*a*), which is indicated by the dial gauge (3*b*), and the bullet (10) has begun entering the case neck (11*c*).

Figure 5:
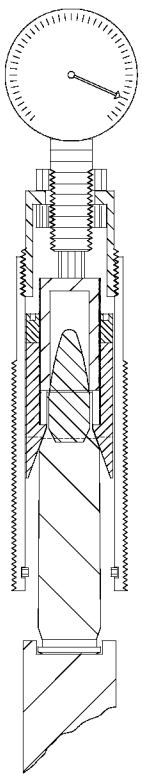

FIG. 5 illustrates when the ram (12) has raised to the point where the case shoulder (11*b*) has contacted the mouth of the case stop (8*b*). The case shoulder datum (11*a*) is level with the case stop mouth datum (8*a*). The dial of the force gauge (3*b*) indicates an increased force.

Figure 6:
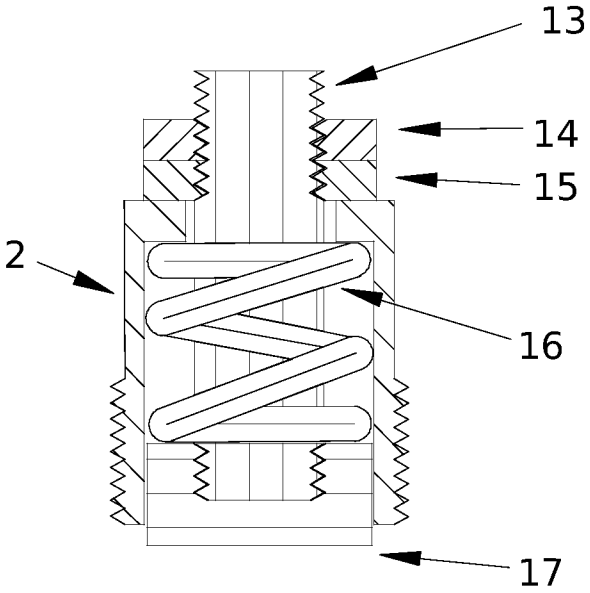

FIG. 6 illustrates a lower cost alternative to the force gauge (3), which is comprised of:

- the stem (13), a threaded shaft going through the same cap (2) of FIG. 1;
- two nuts (14 and 15) threaded onto the stem (13) above the cap (2);
- a coil spring (16) below the cap (2);
- and a spring base (17) threaded onto the end of the stem (13).

Figure 7:
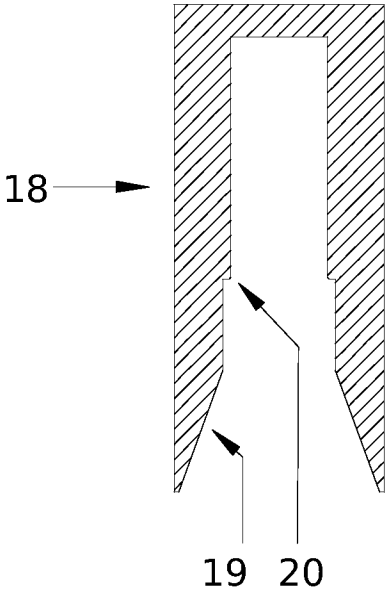

FIG. 7 illustrates the fixed stop (18), a non-adjustable monolithic variant of the case stop (8), bullet stop (6), and lock ring (7) assembly. The conical mouth (19) is equivalent to the mouth (8*b*) of the case stop (8) with a median diameter and cone angle that matches the case shoulder (11*b*). A blind bore (20) is equivalent to the bore (6*a*) of the bullet stop (6) with a diameter that matches the bullet datum (10*a*), which is the same as the bore diameter defined in the SAMMI specification for the cartridge.

DETAILED DESCRIPTION OF THE INVENTION

Disclosed is a novel design for a bullet seating die, the Shoulder Breeching Seating Die. The objective of this invention is better control of bullet jump and better concentricity than what is provided by existing die designs. The theory of operation is specific to rimless shoulder breeching cartridges and not recommended for cartridges with rimmed or belted cases.

The Shoulder Breeching Seating Die (1-9) controls bullet jump better than existing seating die designs because the seating depth is based on the distance between the case shoulder datum line (11*a*) and the bullet datum line (10*a*). All other designs set the bullet depth by controlling the distance between the head of the case (11) (the end opposite the bullet) and the tip of the bullet (10), which is only appropriate for rimmed and belted cases. This is evident because all of them work, in conjunction with the press, by using the same general principle of operation wherein the seating die controls the final position of the tip (or somewhere near the tip) of the bullet and the press controls the final position of the case. This is true for presses with a ram that raises the case, presses that lower the die, or arbor presses that push the die onto a stationary case; the direction of travel may be reversed but the endpoint is the same.

The Shoulder Breeching Seating Die (1-9) controls both the final position of the bullet datum (10*a*) and the final position of the case shoulder datum (11*a*). This is accomplished with the adjustable Stop Assembly, which is comprised of the bullet stop (6), a lock ring (7), and the case top (8). The bullet stop (6) has a blind bore (6*a*) with a diameter equal to the diameter of the bullet datum (10*a*), which is equal to the bore diameter defined in the SAMMI specification for the cartridge being loaded. The bullet (10), having a circular cross section, will settle into the round bore (6*a*)

of the bullet stop (6) with the central axis of the bullet (10) co-axial with the axis of the bore (6*a*) and (because they have the same diameter) with the bullet datum (10*a*) in longitudinal alignment with the bottom edge of the bore (6*a*). The case stop (8) has a conical mouth (8*b*) with a median diameter (8*a*) equal to the case shoulder datum diameter (11*a*) and with a cone angle equal to the cone angle of the case shoulder (11*b*). Therefore, when a case (11) engages the case stop (8) the central axis of the case shoulder (11*b*) will become co-axial with the central axis of the case stop mouth (8*b*), and the case shoulder datum (11*a*) will be in longitudinal alignment with the case stop mouth datum (8*a*). The threads (6*b* and 8*c*) connecting the bullet stop (6) and the case stop (8) are precision threads carefully machined to ensure that the bore in the bullet stop (6*a*) remains concentric (co-axial) with the conical mouth (8*b*) of the case stop (8) so that the bullet (10) is held concentric (co-axial) with the case shoulder (11*b*) while the bullet (10) is pressed into the neck (11*c*).

The resulting seating depth, the distance between the bullet datum (10*a*) and the case shoulder datum (11*a*), is controlled by adjusting the distance between the bottom of the bullet stop (6) and the case stop mouth datum (8*a*). The Stop Assembly (6-8) must be removed from the shell (1) either by removing the c-clip (9) or the cap (2) to make the adjustment. Adjusting the Stop Assembly (6-8) is done by turning the bullet stop (6) relative to the case stop (8); the precision threads (6*b* and 8*c*) cause the two stops (6 and 8) to move relative to each other longitudinally while preserving their concentricity. Tightening the lock-ring (7) maintains the established position.

Once adjusted, the Stop Assembly (6-8) is then reinserted into the shell (1). The fully assembled die (1-9) is then installed into a loading press. Unlike existing seating die, where the position of the die in the press affects the final seating depth and must therefore be adjusted every time the die is installed in the press, the position of the shell (1) in the press does not affect the final bullet seating depth. The optimum position for the shell (1) in the press is found by placing a case (11) (without a bullet (10)) on the ram (12) and raising the ram to its utmost position and then positioning the shell (1) so that the Stop Assembly (6-8) is pressed against the force gauge probe (3*a*) just enough to register a small force on the gauge dial (3*b*).

The Shoulder Breeching Seating Die (1-9) is now used in a way similar to how other die are used: a case (11) is placed on top of the ram (12), a bullet (10) is placed on top of the case neck (11*c*), then the ram (12) is slowly raised until the bullet (10) enters the case stop mouth (8*b*), then the ram (12) is raised in a single smooth motion while monitoring the force gauge dial (3*b*) and feeling for when the case shoulder (11*b*) has fully seated against the case stop mouth (8*b*). The ram (12) is lowered and a fully assembled cartridge is removed. It is the sequence of events that occur within the Shoulder Breeching Seating Die (1-9) as the ram (12) is being raised that distinguish the Shoulder Breeching Seating Die (1-9) from other seating die designs. These events are detailed in the FIGS. 1 through 5.

FIG. 1 illustrates a point in time just after the start of the seating process where the ram (12) has raised the case (11) to where the bullet (10) has just entered the mouth (8*b*) of the case stop (8). The bullet (10) is poorly aligned; illustrated is a worst case scenario. The weight of the Stop Assembly (6-8) keeps it at the bottom of the shell (1), sitting on the c-clip (9).

FIG. 2 illustrates the point in time during the loading process where the bullet (10) has passed through the mouth (8*b*) of the case stop (8). In this first stage of the alignment process the alignment of the bullet (10) has been corrected, but not perfected. The bullet (10) has begun to enter the bore (6*a*) of the bullet stop (6) but has not made contact with it. Therefore, the Stop Assembly (6-8) is still sitting on the c-clip (9).

FIG. 3 illustrates the point in time during the loading process where the bullet (10) has engaged the bore (6*a*) of the bullet stop (6) and is now lifting the Stop Assembly (6-8) as the ram (12) raises the case (11). The bullet datum (10*a*) is level with the bottom edge of the bore (6*a*) of the bullet stop (6). The tapered bullet (10) settles into the round bore (6*a*), becoming co-axial with it, which means that it is now co-axial with the case stop mouth (8*b*); this is the second stage of the alignment process. The tapered tail of the bullet (10) is inside the case neck (11*c*) but the bullet (10) has not truly begun to enter it. The Stop Assembly (6-8) has not yet made contact with the probe (3*a*) of the force gauge (3); the gauge dial (3*b*) is still at its minimum.

FIG. 4 illustrates the point in time during the loading process shortly after the Stop Assembly (6-8) has made contact with the probe (3*a*) of the force gauge (3). The case (11) is now being pushed onto the bullet (10), which is now held stationary against the bore (6*a*) of the bullet stop (6), which is pushing on the probe (3*a*) of the force gauge (3), which is indicated on the gauge dial (3*b*), which would be felt by the press operator.

FIG. 5 illustrates the point in time during the loading process shortly after the shoulder of the case (11*b*) has made contact with the mouth (8*b*) of case stop (8), which is indicated by the increased reading at the gauge dial (3*b*), and which would be felt by the press operator. The bullet (10) is now fully seated into the case neck (11*c*). The bullet datum (10*a*) is still level with the bottom of the bore (6*a*) of the bullet stop (6). The case shoulder datum (11*a*) is now level with the case stop mouth datum (8*a*). The case shoulder (11*b*) is now being pressed against the case stop mouth (8*b*), which is a truncated-cone-to-truncated-cone interface. Therefore, the axis of the case shoulder (11*b*) has become co-axial with the axis of the case stop mouth (8*b*), which is co-axial with the bullet (10). This is the third stage of the alignment process.

This achieves the unique result that the bullet datum (10*a*) ends up a known distance from the case shoulder datum (11*b*) independent of any variation in the shape or length of either the bullet (10) or the case (11) and the axis of the bullet (10) is co-axial (concentric) with the case shoulder (11*b*). Other notable aspects of this die design include:

- the above result is also insensitive to the position of the shell (1) in the press, which means
- the Shoulder Breeching Seating Die (1-9) can be removed from the press and reinserted without affecting the result;
- different Stop Assemblies (6-8) can be used with the same shell (1);
- the Stop Assembly (6-8) (or a variant of it) can be used alone in an arbor type loading press or in many other types of presses (from a simple hammer to industrial automation).

The force gauge (3) is not required but the Shoulder Breeching Seating Die (1-9) must be able to accommodate variations in the length of the case (11), or something is likely to be damaged. The force gauge (3) provides this accommodation when the probe is deflected. FIG. 6 illustrates a cheaper solution: a spring (16) with a spring force greater than the force required to press the bullet (10) into the case neck (11*c*) but lower than the force that would cause any damage. A stem (13) and some nuts (14, 15, and 17) press the spring into the interior of the cap (2), which slightly preloads the spring (16) but allows enough additional compression to absorb changes in length of the case (11). The shell (1) is positioned in the press so that the two outer nuts (14 and 15) will lift slightly off of the cap (2) when the ram (12) is at its utmost position during normal operation. Excessive lifting of the nuts (14 and 15) off of the cap (2) indicates that the bullet (10) did not enter the case neck (11*c*) properly and the cartridge should be carefully inspected.

FIG. 7 illustrates the Fixed Stop (18), a non-adjustable version of the Stop Assembly (6-8), which can not be used to optimize bullet jump but would cost less to manufacture and will produce cartridges with a more consistent bullet depth than existing designs. The conical mouth (19) is equivalent to the mouth (8*b*) of the case stop (8) with a median diameter and cone angle that matches the case shoulder (11*b*). A blind bore (20) is equivalent to the bore (6*a*) of the bullet stop (6) with a diameter that matches the bullet datum (10*a*), which is the same as the bore diameter defined in the SAMMI specification for the cartridge.

I claim:

1. An apparatus for assembling an ammunition cartridge,
said apparatus being operated by application of an external force,
said force being generated by one of the group consisting of a press or a hammer,
said ammunition cartridge comprising a bullet and a case,
said bullet comprising a cylindrical base and a tapered tip,
said base of said bullet having a diameter,
said case comprising a conical shoulder and a cylindrical neck,
said shoulder of said case having a cone angle and a median diameter,
said ammunition cartridge being assembled for use in a firearm,
said firearm comprising a barrel,
said barrel comprising a chamber and a bore,
said bore having a diameter,
said diameter of said bore being smaller than said diameter of said base of said bullet,
said apparatus comprising:
a bullet-stop, said bullet-stop comprising a bore, said bore of said bullet-stop having a diameter, said diameter of said bore of said bullet-stop being equal to said diameter of said bore of said barrel;
and a case-stop, said case-stop comprising a bore with a conical mouth, said mouth having a cone angle and a median diameter, said cone angle of said mouth being equal to said cone angle of said shoulder of said case, said median diameter of said mouth being equal to said median diameter of said shoulder of said case;
the distance between said bore of said bullet-stop and said median diameter of said mouth of said case-stop being constant during assembly of said cartridge,
said force pressing said tip of said bullet against said bore of said bullet-stop,
said pressing inserting said base of said bullet into said neck of said case,
said insertion continuing until said conical shoulder of said case is pressed against said conical mouth of said bore of said case-stop.

2. An apparatus according to claim 1 further comprising a means for adjusting said distance between said bore of said bullet-stop and said median diameter of said conical mouth of said case-stop prior to assembly of said cartridge, said means including a threaded connection between said bullet-stop and said case-stop.

3. An apparatus according to claim 1 or claim 2 further comprising one of the group consisting of a force gauge, a spring, or an elastomeric material that is compressed by said bullet-stop during application of said force.

* * * * *